US005462279A

United States Patent [19]

Culpepper

[11] Patent Number: 5,462,279

[45] Date of Patent: Oct. 31, 1995

[54] GOLF CLUB CAPABLE OF SELECTIVE ANGLE MODIFICATION BETWEEN THE HOSEL AND HEAD, AND SELECTIVE SHAFT LENGTH AND METHOD OF ASSEMBLING THE GOLF CLUB

[76] Inventor: Royce L. Culpepper, 1015 Normandy Dr., Clinton, Miss. 39056

[21] Appl. No.: 305,388

[22] Filed: Sep. 13, 1994

Related U.S. Application Data

[63] Continuation-in-part of Ser. No. 314,447, Dec. 22, 1993, abandoned, which is a continuation-in-part of Ser. No. 835,526, Feb. 14, 1992, abandoned, which is a continuation-in-part of Ser. No. 624,344, Dec. 6, 1990, abandoned.

[51] Int. Cl.[6] ..... A63B 53/04

[52] U.S. Cl. ..... 273/164.1; 273/80 C; 273/167 G; 273/80.1

[58] Field of Search ..... 273/167 R, 168, 273/78, 169, 80 C, 170, 171, 172, 173, 174, 175, 167 A, 167 B, 167 C, 167 D, 167 E, 167 F, 167 G, 167 H, 167 K, 164.1, 187.4, 79, 193 R, 194 R, 80.1–80.9; D21/214, 219; 403/258–260, 334

[56] References Cited

U.S. PATENT DOCUMENTS

| | | | |
|---|---|---|---|
| 1,657,972 | 1/1928 | Rowe | 273/80 R X |
| 3,328,032 | 6/1967 | Griswold | 273/163 R X |
| 3,413,926 | 12/1968 | Ayson | 403/260 X |
| 3,448,981 | 6/1969 | Anweiler | 273/164.1 X |
| 4,519,612 | 5/1985 | Tsao | 273/171 X |
| 4,815,740 | 3/1989 | Williams et al. | 273/80.2 X |
| 4,984,794 | 1/1991 | Pernelle et al. | 273/80.1 |

FOREIGN PATENT DOCUMENTS

| | | | |
|---|---|---|---|
| 800486 | 12/1968 | Canada | 273/163 R |
| 1222263 | 5/1987 | Canada | 273/80.1 |
| 195812 | 4/1923 | United Kingdom | 273/164.1 |

*Primary Examiner*—Sebastiano Passaniti
*Attorney, Agent, or Firm*—Lorusso & Loud

[57] ABSTRACT

A golf club includes a head, hosel, grip, and shaft. At the time of attachment of the hosel to the club head, the club head is positionable relative to the shaft at a plurality of angles, of not less than 10 degrees in relation to the shaft and hosel assembly. The present invention permits the golf club to be configured to fit the golfer with respect to total club length and angular relation of club head to shaft and hosel, for a right handed or left handed golfer and to be assembled to fit the individual golfer in accordance with height, stature and personal preference of the individual. The design permits the sole of the club head to remain substantially flat with respect to the putting surface, and is consistent with the "USGA Rules of Golf."

14 Claims, 3 Drawing Sheets

GOLF CLUB CAPABLE OF SELECTIVE ANGLE MODIFICATION BETWEEN THE HOSEL AND HEAD, AND SELECTIVE SHAFT LENGTH AND METHOD OF ASSEMBLING THE GOLF CLUB

CROSS REFERENCE TO RELATED APPLICATIONS

This application is a continuation-in-part of U.S. application Ser. No. 08/314,447, filed Dec. 22, 1993, now abandoned, which, in turn, is continuation-in-part of U.S. application Ser. No. 07/835,526, filed Feb. 14, 1992, now abandoned, which, in turn, is a continuation-in-part of U.S. Ser. No. 07/624,344, filed Dec. 6, 1990, now abandoned.

BACKGROUND OF INVENTION

1. Field of Invention

The present invention relates to a golf club in which the hosel and shaft assembly in which the "angle of connection" of said assembly to the head may be selectively set. The present invention also relates to a method of assembling the club.

2. Discussion of Background and Relevant Information

A golf club conventionally includes a grip, a shaft, typically metallic and tubular, connected to a hosel which, in turn, is connected to a club head. The assembly of the shaft and hosel is generally achieved by nesting one within the other and bonding with epoxy, whereby the two assembly parts become solidly affixed to the head with complementary support zones. The head of the golf club constitutes the physical ball-striking element of the club. To aid in correct striking of the ball it is necessary to have the sole of the club head remain parallel to the putting surface, the hosel and shaft assembly thus forming an angle (alpha) with respect to the vertical.

The angle alpha, which can be defined with respect to the vertical or with respect to the horizontal, as shown in FIG. 4, constitutes the angle called the "angle of connection" or connecting angle of the assembly of hosel and shaft in relation to the club head. The angle alpha is most commonly called the "lie" by golfers and golf equipment manufacturers.

The ideal "angle of connection," of hosel and shaft with respect to the club head varies according to the golfer and depends, essentially, on the position of play, the stature, and the personal preference of the individual golfer.

Thus, one seeks, particularly in the case of precision clubs like putters, to be able to easily modify the "angle of connection" of hosel and club head without violating USGA Rules specifying a minimum divergence of 10 degrees from the vertical angle of the combined hosel and shaft in relation to the horizontal sole plane, i.e. where the sole of the putter head is parallel to the putting surface. It is also desirable to be able to modify the total club length by modification of the length of the shaft, to adapt it to the playing position and personal preference of the golfer.

Currently, different solutions have been proposed to resolve the foregoing problems.

One solution is to provide the desired "angle of connection" of shaft and hosel at the time of manufacture. Such a solution is expensive, in view of the need for a separate mold for each angular difference. Thus, this is an impractical and unsatisfactory solution.

A second solution is to achieve the desired "angle of connection" of shaft and hosel in relation to club head by deformation of the shaft to achieve the desired angular difference between club head and shaft. This is not a practical or satisfactory solution in view of significant deformation of the malleable shaft causing fatigue and possible breaking of the shaft. Further, as the deformation is often done manually, the "angle of connection" is not obtained with sufficient precision.

SUMMARY OF INVENTION

Accordingly, it is an object of the present invention to overcome the disadvantages of prior art methods and devices by providing a golf club which includes:

a. a combined hosel and shaft assembly, the shaft defining a longitudinal shaft axis and the hosel including a first leg portion and a second leg portion integral with said first leg portion, the first leg portion defining a hosel axis parallel to and offset from the shaft axis and having a distal end with a first connection, the second leg portion connecting the first leg portion to the shaft; and b. a head having a toe end, a heel end, a ground engaging surface, a rear side and a flat, ball-striking face extending between the toe end and the heel end and defining a first plane parallel to the shaft axis and the hosel axis; having a second connection for mating with the first connection to secure the head to the shaft and hosel assembly and extending perpendicular to the ball-striking face from a point on the rear side centered between the toe and the heel end and defining an axis of rotation for the shaft in a second plane parallel to the first plane, the axis of rotation being perpendicular to the ball-striking face; wherein one of the first and second connections is a socket having a tapered cylindrical interior surface and the other of the first and second connections is a tapered pin having a tapered cylindrical exterior surface for mating with the interior surface; whereby the ball-striking face may remain perpendicular to the ground with rotation of the shaft in the second plane.

A preferred embodiment further includes an angular stop, as a projection from the head, to assure that the hosel can only be affixed to the club head at a hosel-to-head angle of 10 degrees or more, either side of vertical, in accordance with needs and desires of the user. Therefore, as shown in the drawings, the invention is an ambidextrous club that can be readily fitted to either a left or right handed golfer with the lie and total length of the putter fitted to the individual in accordance with USGA rules.

BRIEF DESCRIPTION OF DRAWINGS

The invention will be better understood and other characteristics will be clarified by means of the description which follows, with reference to the annexed drawings, illustrating by way of a non-limiting example, a preferred embodiment in which.

DESCRIPTION OF THE PREFERRED EMBODIMENTS

Figure 4:
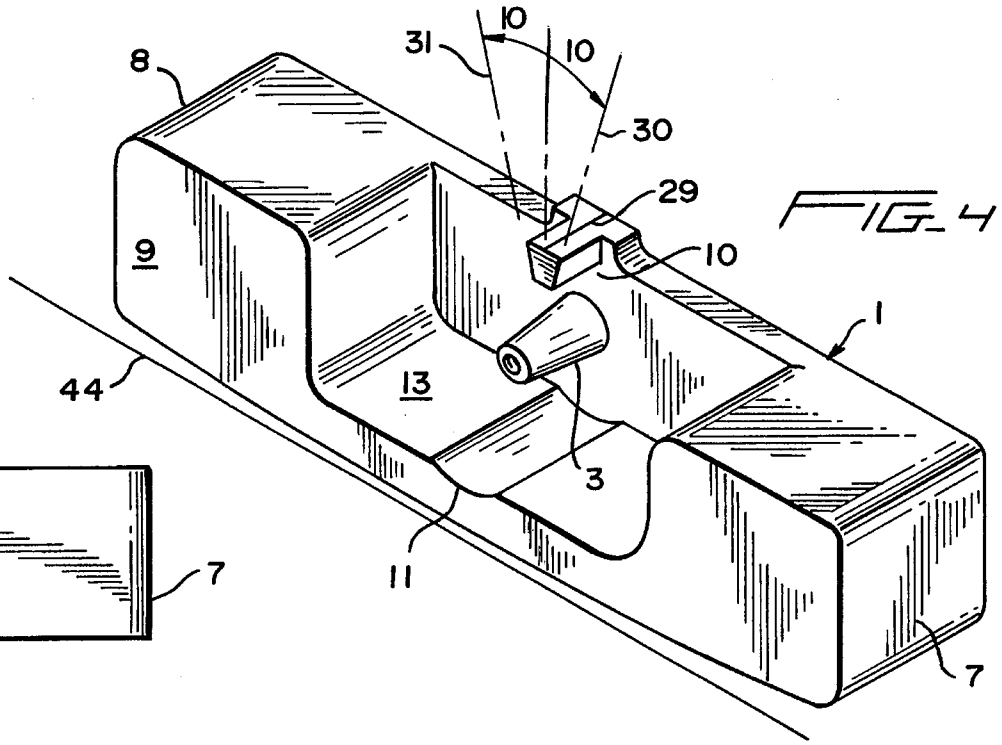
FIG. 4 is an oblique rear view of the club head showing the angular stop and alignment aid extending rearward from the club head with a generally triangular form to assure that the hosel, when attached, is not less than a 10 degree angle from vertical in relation to the club head horizontal sole plane (44)
Figure 2:
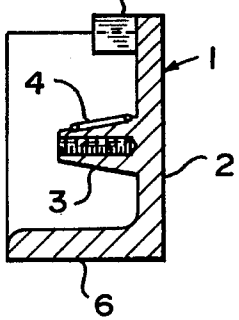
FIG. 2 is a cross-sectional view of the club head depicting the rearward projection of the angular stop and alignment aid.
Figure 3:
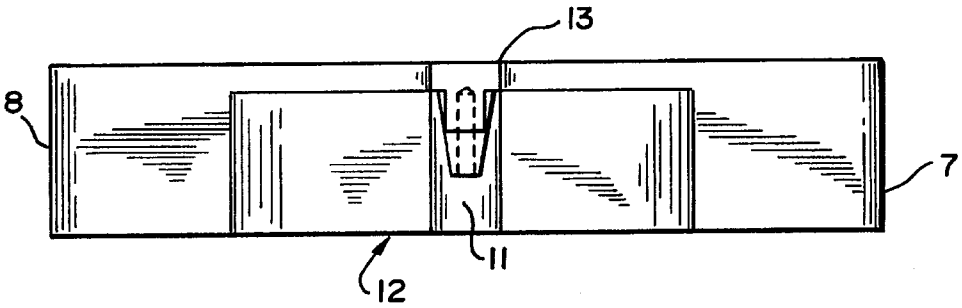
FIG. 3 is top plan view of the club head depicting balanced toe and heel.
Figure 1:
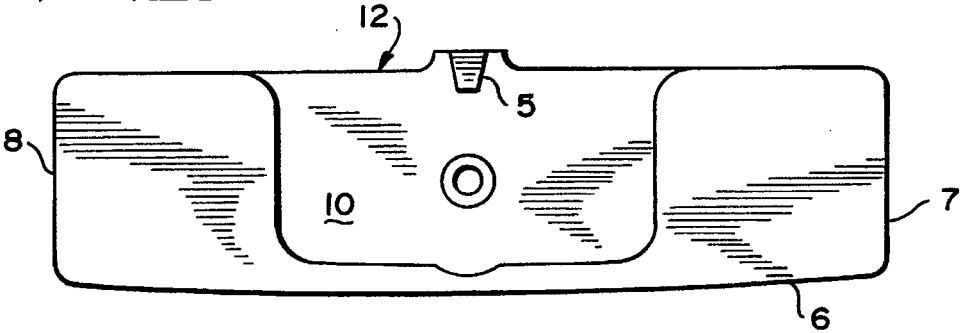
FIG. 1 is a rear elevation view of the club head.
Figure 6:
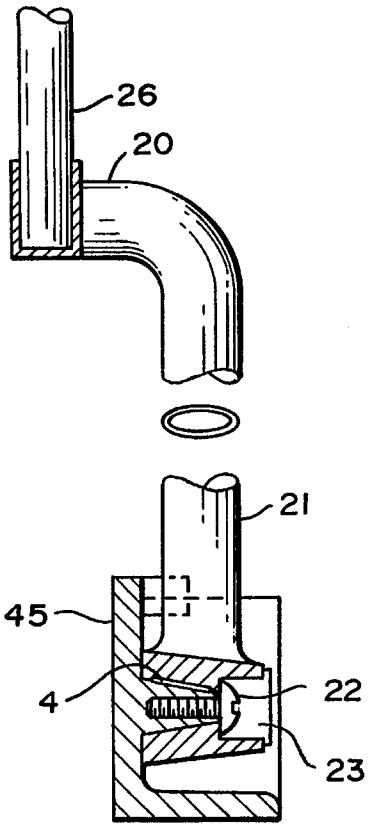
FIG. 6 is an elevational view of the shaft-hosel-head assembly with the connections shown in cross-section.
Figure 5:
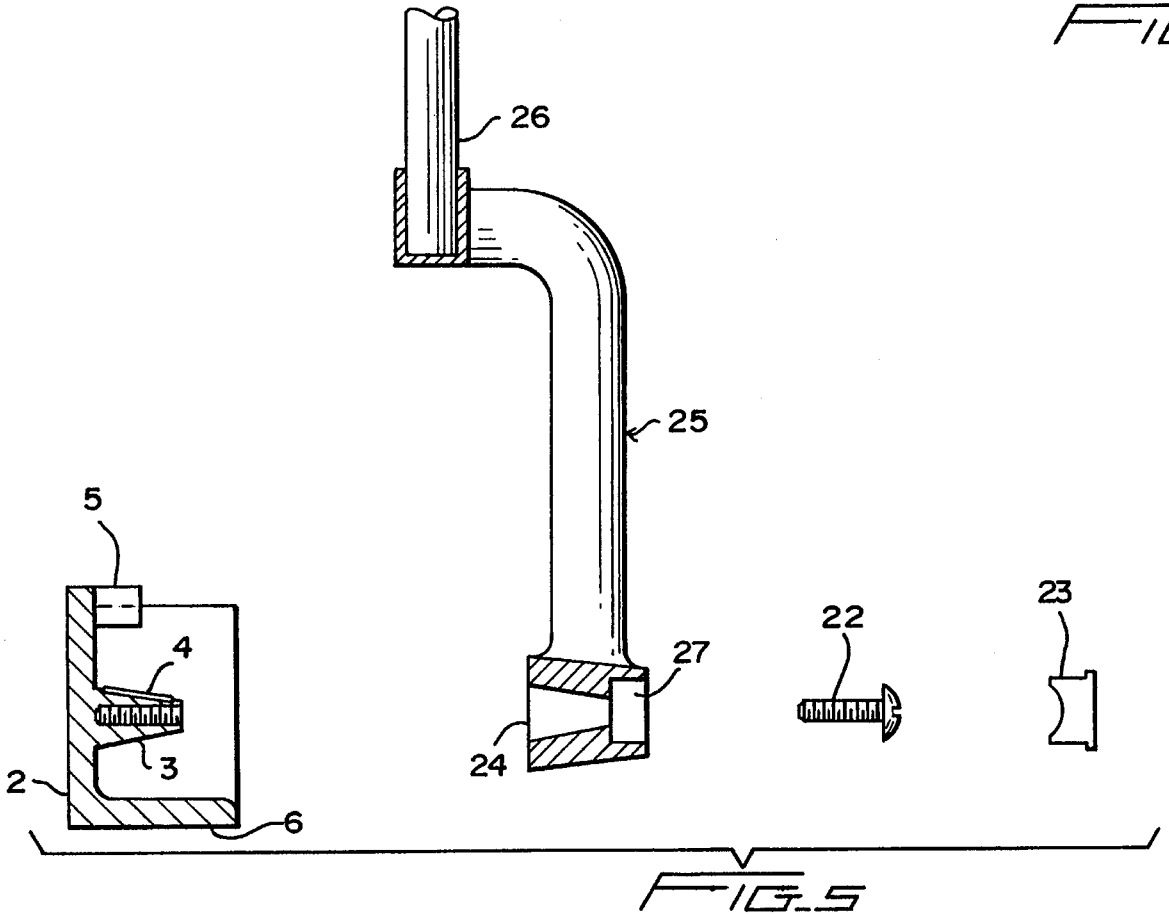
FIG. 5 is a cross-sectional view of the club head and first connection of the hosel, with the shaft, screw and cover cap.
Figure 7:
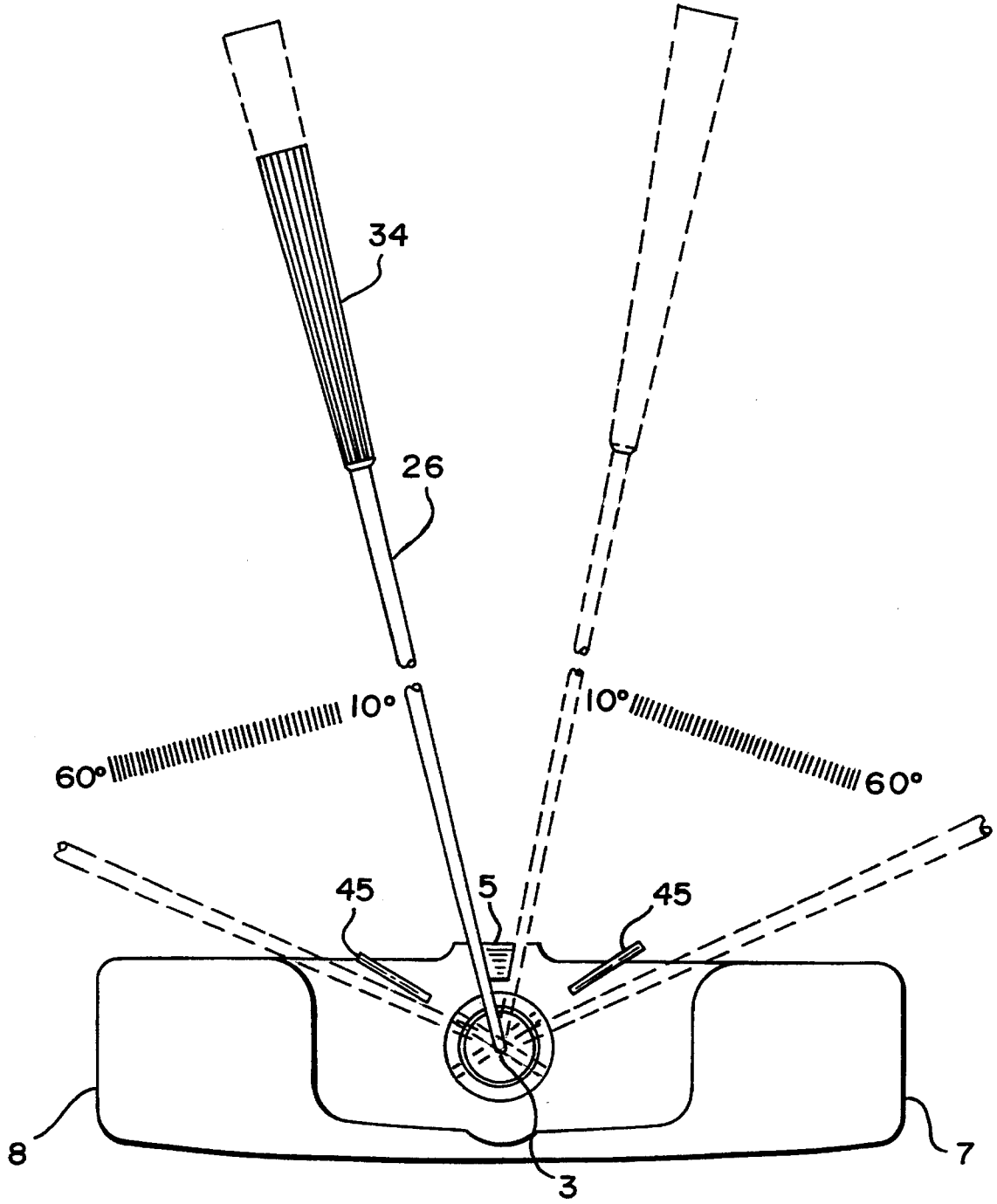
FIG. 7 is a rear view of the putter showing the multiple angles of not less than 10 degrees that the hosel and shaft can be assembled in relation to the club head.

As shown in FIG. 5, the hosel of the golf club of the present invention includes a first connection in the form of a socket 24 having a tapered cylindrical internal surface. The second connection, carried by the head 1, is a pin 3 having an external surface for mating with the tapered cylindrical surface of socket 24. As seen in FIGS. 5 and 6, hosel 25 includes a first leg portion 21 having a longitudinal axis parallel to that of the shaft 26 and a second leg portion 20 connecting the first leg portion with the shaft 26.

As shown in FIGS. 1–7, the club head 1 has a ball-striking face 2, a sole 6, a rear side 9, a toe 7 and a heel 8. The club head further has a protrusion or angular stop 5 with a line 29 (FIG. 4) serving as an alignment aid, as an integral part of the club head 1 extending from the center of the rear side 9 of the club head. The angular stop 5 assures assembly of the hosel 25 at not less than 10 degrees from vertical, in relation to the club head.

In the preferred embodiment the weight of the club head 43 is equally divided between the toe 7 and the heel 8 which are equidistant from the horizontal center of the club head and second connection or pin 3, thereby minimizing the travel of the ball off the intended line when the contact of putter and ball is not at the approximate center of the club face.

Further, according to the invention, the shaft-to-hosel connection provides an additional line of sight along shaft 26 to a point one half the diameter of a USGA approved golf ball forward of the club face, thereby creating two converging sight lines at the approximate center of the golf ball.

In a preferred embodiment the invention, a steel wire 4 provides a locking means for fixing the angle between the hosel and the head by becoming wedged between the internal surface of the socket 24 and the external surface of the pin 3 thereby creating an indention in both of the pin and socket and resistance to rotation between the club head and hosel assemblies when tightened together with a one-way screw 22. This locking means prevents changing playing characteristics of the club by means other than special shop tools, i.e. a drill press, vise and specialty pliers, and thereby prevents altering the playing characteristics of the club during a "stipulated round of golf," in violation of USGA rules.

As shown in FIGS. 5 and 6 a cap 23 blocks access to the one-way screw 22 after assembly of the golf club, which further prevents altering playing characteristics of the golf club during a stipulated round of play. Still further, a quantity of epoxy (not shown) is used to bond the cap 23 to the hosel 25. Finally, a standard industrial roll pin 45 is inserted into a hole drilled through the socket 24 of the hosel 25 and into the tapered pin 3 of the head to effect a permanent assembly that cannot be altered during a stipulated round in violation of USGA rules.

As seen in FIGS. 1–4, the club head 1 has a rear recess 12 defined by a peripheral surface 13 and a recessed face 10. Faces 9 and 10 lie in planes between which is located the distal end of pin 3. A lower recess 11 in peripheral surface 13 accommodates the socket 24.

The present invention also furnishes an assembly process for a golf club, of the type in which assembly is achieved by the nesting and joining of two assembly parts having first and second connections which are complementary and solidly affixed to the hosel and head of the club, which is inexpensive to implement, and which utilizes readily available standard shafts and further permits achievement of an "angle of connection" with precision.

Thus, the relative angular position of the two assembly parts is determined at the time of connection of the two parts within a latitude of angles consistent with the USGA Rules of Golf, without use of special tooling. The triangular extension of the alignment aid rearward in relation to the club face assures a minimum angular relationship of hosel to club head of 10 degrees, in relation to vertical.

FIG. 5 shows all components of the assembly including the wire 4 which resists rotation by creating an indentation in both the hosel 25 and tapered pin 3 when tightly nested together by the one-way screw 22 to ensure a permanent angular relationship of head and hosel. Further, the cap 23 is glued (glue not shown) into a recess 27 formed opposite socket 24 in the hosel 25 at the time of assembly, thereby preventing access to the screw 22. Also shown is the nesting of shaft 26 into the upper end of hosel 25 (distal end of second leg portion 20), also bonded by epoxy (not shown). The upper hosel connection assures that the longitudinal axis of a first leg 21 of the hosel 25 will place a line of sight along the shaft 26 forward of the club face approximately one-half diameter of a USGA approved golf ball, creating two converging lines of sight: the shaft line of sight and the alignment aid line 29, converging at a point approximately at the center of the golf ball in relation to club face 2, preparatory to striking the golf ball.

What is claimed is:

1. A golf club comprising:

a shaft and hosel assembly, said shaft defining a longitudinal shaft axis and said hosel including a first leg portion and a second leg portion integral with said first leg portion, said first leg portion defining a hosel axis parallel to and offset from said shaft axis and having a distal end with a first connection, said second leg portion connecting said first leg portion to said shaft; and a head having a toe end, a heel end, a ground engaging surface, a rear side, a flat, ball-striking face extending between said toe end and said heel end and defining a first plane parallel to said shaft axis and said hosel axis, and a second connection for mating with said first connection to secure said head to said shaft and hosel assembly, said second connection extending perpendicular to said ball-striking face from a point on said rear side centered between said toe end and said heel end and defining an axis of rotation for said shaft in a second plane parallel to said first plane, said axis of rotation being perpendicular to said ball-striking surface, one of said first and second connections being a socket having a tapered cylindrical interior surface and the other of said first and second connections being a tapered pin having a tapered cylindrical exterior surface for mating with said interior surface, whereby said ball-striking face may remain perpendicular to the ground with rotation of said shaft in said second plane.

2. A golf club in accordance with claim 1 wherein said shaft and hosel assembly is rotatable with respect to said head, about said axis of rotation, to allow for orientation of the shaft with respect to the head to accommodate both right handed and left handed users and to allow the angle between the shaft and the head to be custom set for the user.

3. A golf club in accordance with claim 2 further comprising an angular stop in the form of a protrusion extending from said rear side, parallel to and spaced from said second connection, opposite said ground engaging surface, said angular stop preventing said angle from being set less than 10 degrees either side of a line extending perpendicular from said ground engaging surface through said axis of rotation.

4. A golf club in accordance with claim 3 further comprising means on said angular stop defining a visible line for alignment of a golf ball resting against said striking surface and centered on said axis of rotation.

5. A golf club in accordance with claim 1 further comprising locking means for permanently locking the position of said shaft and hosel assembly relative to said head.

6. A golf club in accordance with claim 5 wherein said locking means comprises a headed screw, a threaded bore in said pin along said axis of rotation and a circumferential shoulder defined by said socket whereby said headed screw is drawn flush against said shoulder upon being threaded into said threaded bore.

7. A golf club in accordance with claim 6 further comprising a recess in said socket, said recess forming said shoulder as a bottom surface.

8. A golf club in accordance with claim 7 further comprising a cap covering said recess and solidified resin within said recess between said cap and said screw.

9. A golf club in accordance with claim 6 wherein said headed screw is a one-way screw.

10. A golf club in accordance with claim 1 wherein said rear side defines a rear face and has a recess defining a recessed face parallel to said rear face, said second connection extending from said recessed face and terminating at a point between said recessed face and said rear face.

11. A golf club in accordance with claim 1 wherein the offset between said shaft axis and said hosel axis provides a line of sight along said shaft to the center of a USGA dimensioned golf ball abutting said ball-striking face and aligned with said axis of rotation.

12. A golf club in accordance with claim 4 wherein the offset between said shaft axis and said hosel axis provides a line of sight along said shaft to the center of a USGA dimensioned golf ball abutting said ball-striking face and aligned with said axis of rotation.

13. A golf club in accordance with claim 5 wherein said permanent locking means comprises a hard steel wire compressed between said tapered cylindrical interior surface and said tapered cylindrical exterior surface, said steel wire forming an indentation in both said tapered cylindrical interior surface and said tapered cylindrical exterior surface, whereby the steel wire provides an enhanced bond between said first and second connections to prevent rotation of the hosel and shaft assembly relative to the head.

14. A golf club in accordance with claim 5 wherein said permanent locking means comprises a hole extending diametrically through said pin and said socket and a pin fitted within said hole.

* * * * *